US006247253B1

(12) United States Patent
MacIntyre

(10) Patent No.: US 6,247,253 B1
(45) Date of Patent: Jun. 19, 2001

(54) REMOVABLE CLEAT FOR SNOWSHOE

(76) Inventor: S. Scott MacIntyre, P.O. Box 2124, Conway, NH (US) 03818

( * ) Notice: Subject to any disclaimer, the term of this patent is extended or adjusted under 35 U.S.C. 154(b) by 0 days.

(21) Appl. No.: 09/395,779

(22) Filed: Sep. 14, 1999

(51) Int. Cl.[7] ..... A43B 5/04; A43B 5/16; A43C 15/00

(52) U.S. Cl. ..... 36/124; 36/62; 36/64; 36/67 D

(58) Field of Search ..... 24/279, 274 WB, 24/278; 36/122, 123, 124, 125, 134, 670, 59 R, 62, 64, 67 R, 67 A, 67 B, 66, 113

(56) References Cited

U.S. PATENT DOCUMENTS

| | | | |
|---|---|---|---|
| 659,908 | | 10/1900 | Appleman . |
| 662,225 | * | 11/1900 | Diehl . |
| 810,419 | | 1/1906 | Kirkpatrick . |
| 1,142,967 | | 6/1915 | Kaszubski . |
| 1,373,673 | * | 4/1921 | Ritter . |
| 1,513,539 | | 10/1924 | East . |
| 1,573,779 | | 2/1926 | Broman . |
| 2,533,151 | | 12/1950 | Stevens . |
| 2,560,198 | | 7/1951 | Stevens . |
| 2,579,143 | * | 12/1951 | Fisher . |
| 2,720,239 | | 10/1955 | Mason . |
| 2,738,596 | * | 3/1956 | Walsh . |
| 3,802,100 | | 4/1974 | Prater . |
| 4,085,529 | | 4/1978 | Merrifield . |
| 4,428,104 | * | 1/1984 | Smith . |
| 4,513,801 | | 4/1985 | Pedrick et al. . |
| 5,056,196 | * | 10/1991 | van Walraven . |
| 5,253,437 | | 10/1993 | Klebahn et al. . |
| 5,261,470 | | 11/1993 | Genaw et al. . |
| 5,341,582 | | 8/1994 | Liautaud . |
| 5,440,827 | * | 8/1995 | Klebahn et al. . |
| 5,493,794 | | 2/1996 | McKenzie et al. . |
| 5,540,002 | | 7/1996 | Liautaud . |
| 5,687,491 | | 11/1997 | Klebahn . |
| 5,699,630 | | 12/1997 | Klebahn et al. . |
| 5,720,120 | | 2/1998 | Smith . |
| 5,769,444 | | 6/1998 | Mason . |
| 5,787,612 | | 8/1998 | Mahoney et al. . |
| 5,809,667 | | 9/1998 | Liautaud . |
| 5,809,668 | | 9/1998 | Kiniry et al. . |

FOREIGN PATENT DOCUMENTS

| | | |
|---|---|---|
| 529188 | 6/1954 | (BE) . |
| 230486 | 4/1944 | (CH) . |
| 5-269003 | 10/1993 | (JP) . |

OTHER PUBLICATIONS

Cabela's Mid–Winter Sale Catalog, "Denali Llama Show-shoes", p. 62, and "Cabela's Outfitter Snowshoes", p. 63.

* cited by examiner

*Primary Examiner*—Paul T. Sewell
*Assistant Examiner*—Anthony Stashick
(74) *Attorney, Agent, or Firm*—Mattingly, Stanger & Malur, P.C.

(57) ABSTRACT

A removable ice cleat for an outer frame member of a snowshoe provides traction for snow packed and icy conditions. For looser conditions including powdery snow, the ice cleats are quickly removable thus making the snowshoe versatile for all weather conditions. The ice cleat is attached using a metal band clamp that is tightened by a screwdriver or nut driver thereby making deployment of the ice cleats possible while outdoors. The ice cleat has an ice pick that is clamped by the band to the bottom of the outer frame member of the snowshoe. Several ice picks can be clamped in this manner. The picks have legs that extend downwardly and outwardly from a mid portion thereof to pointed ends having a generally triangular shaped penetrating portion that maintains good penetrability even as the pointed end becomes dull.

4 Claims, 2 Drawing Sheets

REMOVABLE CLEAT FOR SNOWSHOE

FIELD OF THE INVENTION

The invention relates to a removable cleat that is mounted on a snowshoe, and in particular to a removable cleat that is mounted on a peripheral frame portion of a snowshoe with a band clamp that provides traction on slippery surfaces.

BACKGROUND OF THE INVENTION

Snowshoes are designed to provide a user with floatation when walking on the snow. Snowshoes generally have an outer frame made from wood, metal or plastic that supports an interior decking. A binding enables the user's footwear to be secured to the snowshoe. The frame and decking provide displacement of the user's body weight over a surface area that is greater than that provided by conventional footwear, thereby enabling floatation of the snowshoe across the surface of the snow.

Snowshoe frame and decking designs have not changed much in recent years. Since the design criteria must satisfy the objective of weight distribution, all snowshoe designs tend to have the same general size, shape and weight. Recent approaches in snowshoe design depart from the more traditional ones by molding the frame and decking of plastic into an integrated unit. This approach tends to reduce the cost of manufacturing the snowshoes and also provides a continuous surface area to which traction enhancing devices, such as cleats, can be permanently attached.

Bindings are also an important part of snowshoe design. There are as many different approaches to binding design as there are different snowshoe designs. Comfort, ease of use, control and durability describe the best bindings of the art. Many designs employ an ice crampon under the center of the binding that pivots downward as the user steps forward to aid with traction. For example, Klebahn et al, U.S. Pat. No. 5,699,630 describes a binding mounted crampon. In addition to the crampon, a metal cleat is screwed or riveted to the decking material below the user's heel to permanently mount the cleat to the snowshoe.

SUMMARY OF THE INVENTION

As a part of the present invention, it is recognized that when a snowshoe is used, the user's weight is transferred from the footbed region of the snowshoe to the suspended area of the decking material and out to the frame. As a result, the gripping ability of traction devices mounted on the decking or in the binding area of the snowshoe is insufficient in many conditions. Accordingly, one object of the present invention is to provide an ice cleat that is able to be mounted to the outer frame of the snowshoe for providing traction on icy or hard-packed snow conditions.

As another part of the present invention, it is recognized that users of snowshoes encounter many different types of conditions, such as deep powdery snow, deep snow with a top layer of ice, hard packed snow and solid ice. While traction devices provide mechanical gripping that is desired on icy or hard-packed snow, traction devices inhibit the snowshoe from easily sliding over snow in looser conditions, such as powdery snow. Accordingly, another object of the present invention is to provide a readily removable ice cleat that is easily mounted or clamped onto the frame of a snowshoe, preferably on the outer periphery of the snowshoe frame, for use in hard packed snow or icy conditions wherein the ice cleats are removable from the snowshoe frame for looser snow conditions, such as powdery snow.

It is yet another object of the present invention to enable a user to mount a selected number of ice cleats, as the conditions warrant, to a peripheral frame of an existing (previously manufactured) snowshoe to enable the user to experience enhanced traction ability of the snowshoe on hard-packed snow and icy surfaces without substantial modification to existing snowshoes.

It is a further object of the invention to provide an ice cleat that is removably mounted on a snowshoe frame that has angled, downwardly facing spikes that are securely mounted to the snowshoe frame. The downwardly facing, outwardly angled spikes prevent snow and ice from being compacted into the space between the spikes, thereby minimizing the need for cleaning the spikes. Further, even when the tips of the angled spikes become rounded over time as a result of use of the cleats, the cleats still provide sufficient traction.

Preferably, the ice cleat of the present invention has a metal band that is clamped around an outer frame member of a snowshoe without modification to the snowshoe frame being required. Further, preferably the band is adjustable to accommodate a range of outer diameters of the outer frame member of snowshoes of various snowshoe designs. The band is constricted in diameter about the outer frame member of the snowshoe to tightly secure the ice cleat to the outer frame member with the spikes pointing downwardly and angled outwardly from the band.

BRIEF DESCRIPTION OF THE PREFERRED EMBODIMENT

FIG. 1 a bottom plan view of a conventional snowshoe to which four removably mounted ice cleats have been secured.

DETAILED DESCRIPTION OF THE PREFERRED EMBODIMENTS

Figure 1:
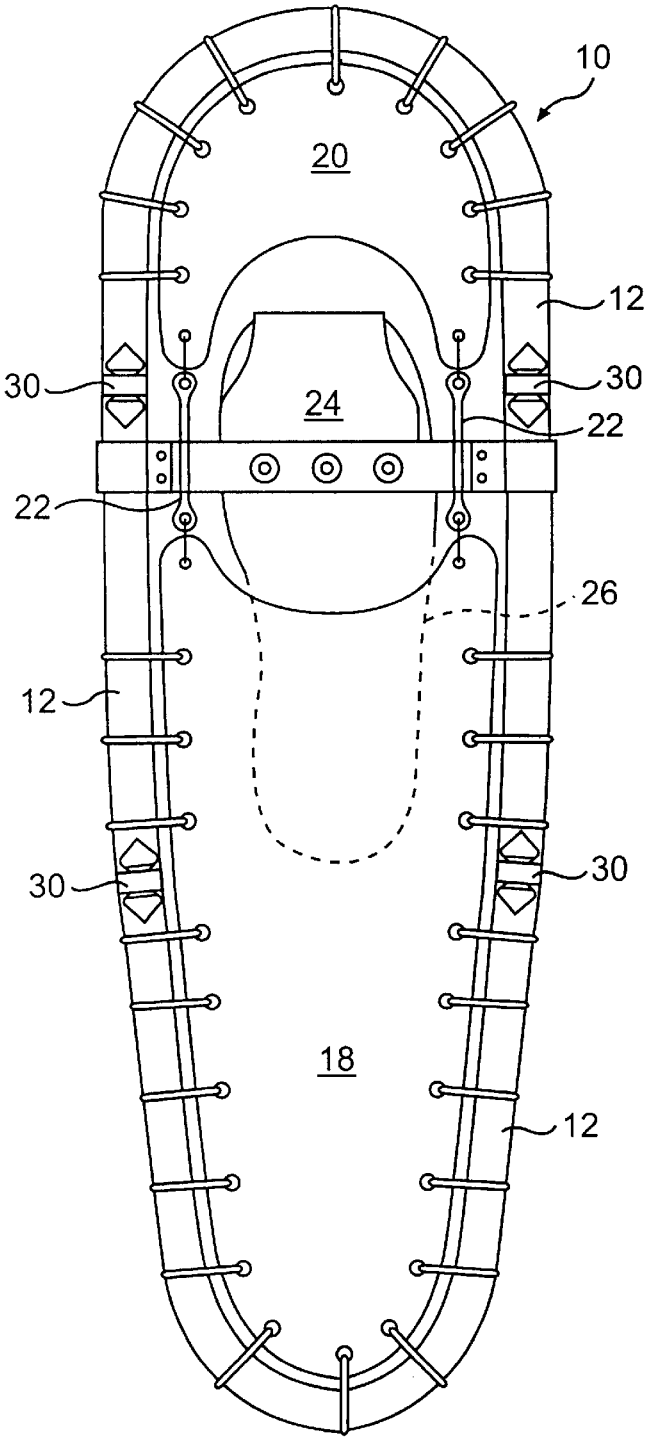
Figure 2:
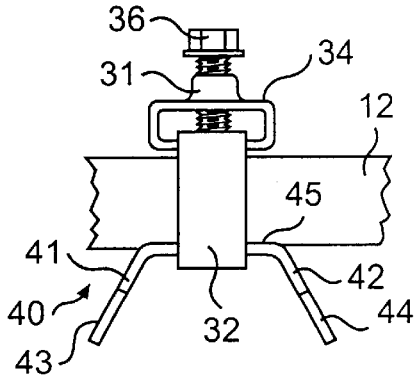
FIG. 2 is a side view of one of the ice cleats shown in FIG. 1.
Figure 3:
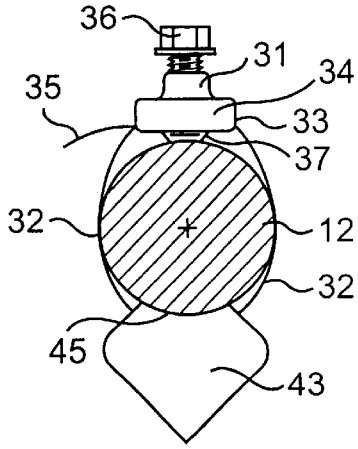
FIG. 3 is an end view of the ice cleat shown in FIG. 2.

FIGS. 1–3 show a first embodiment of the removable ice cleat of the present invention and FIGS. 4–7 show a second embodiment.

In particular, FIG. 1 shows a conventional snowshoe of the type shown in U.S. Pat. No. 4,085,529, the disclosure of which is hereby incorporated by reference. The snowshoe has an outer frame 12 to which is lashed heel decking 18 and toe decking 20. The interconnection between the toe decking and the heel decking 18 is provided by tie bars 22. The snowshoe has a binding generally indicated at 24 to accept a user's footwear 26.

Spaced along the outer frame member 12 are removable ice cleats 30. With reference to FIGS. 2 and 3, the ice cleat has a circular clamp or retaining band 32. Preferably, the retaining band 32 is made of tempered stainless steel. The band is tightened to clamp an ice pick 40 to the outer frame member 12.

Each ice pick 40 has two legs 41 and 42 having respective angled, pointed ends 43, 44. A center portion of the pick 45 is optionally fixed to the band 32 by spot welding, adhesive, a rivet or the like. That is, since the center portion 45 of the ice pick 40 is clamped in place as the band is tightened, it may be desirable for manufacturing purposes to avoid the step of securing the ice pick 40 to the band 32.

As shown in FIG. 3, one end 33 of the band 32 is fixed to buckle 34 and the other end 35 of the band passes through buckle 34 and remains as a free end indicating that the band is large enough to accommodate a wide range of outer diameters of frame member 12. A screw 36 is threaded into a threaded bore 31 of buckle 34. As the screw is tightened, an end 37 of the screw presses down on the band 32 to secure it tightly in place around frame member 12.

FIG. 1 shows four ice cleats 30 mounted on outer frame member 12. The number of ice cleats to be mounted on the snowshoe is not limited to four, however. Since the ice cleats are individually mounted on the snowshoe frame, any number can be used.

The ice cleats can be added/removed by using a screwdriver or nutdriver to tighten/loosen the band that secures the cleat on the snowshoe frame. Accordingly, the cleats can be easily added or removed in the field even when the user is wearing gloves. That is, the screw 36 can be tightened/loosened using a simple hand tool, such as a screwdriver or nut driver.

The ice pick 40 of the ice cleat is preferably formed of steel alloy such as stainless steel and has two legs 41 and 42 that angle downwardly and outwardly with respect to the mid portion 45. As a result of the legs being angled outwardly, no snow or ice is compacted into the space between the pointed ends 43, 44. This has the advantage of insuring that the cleat can penetrate the icy surface being traversed without being limited by compacted snow or ice. Further, the pointed ends 43, 44 have a generally triangular shaped penetration surface as shown in FIG. 3. As the pointed ends are worn down, the surface area that is able to penetrate the slippery surface being traversed is not diminished significantly and hence the traction ability of the cleat is maintained over time.

Figure 4:
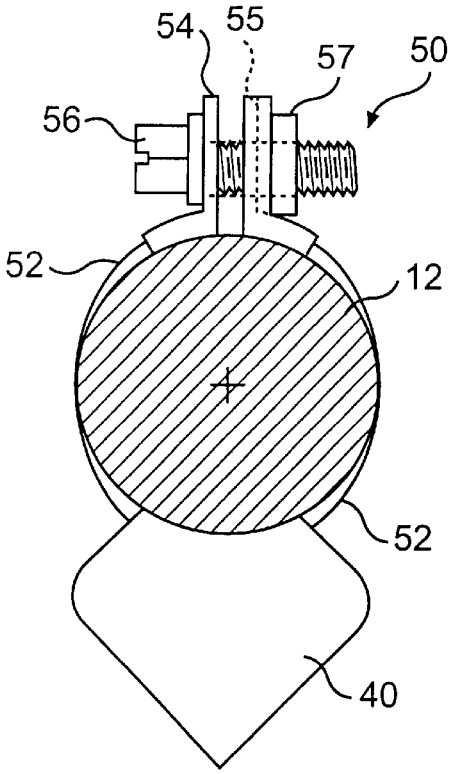
FIG. 4 is an end view of an ice cleat according to a second embodiment of the present invention.
Figure 5:
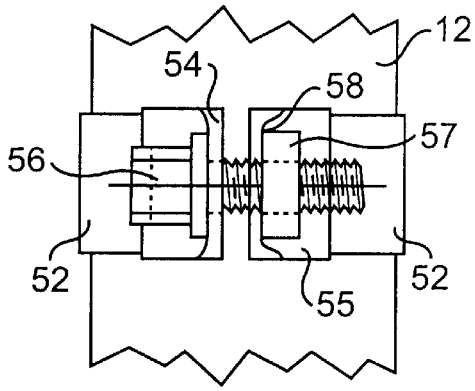
FIG. 5 is a top view of the circular clamp of the ice cleat shown in FIG. 4.

FIGS. 4–7 show another embodiment of the present invention with respect to the band and buckle or clamp arrangement. As shown in FIG. 4, an ice cleat 50 according to a second embodiment of the present invention has the same ice pick structure, and therefore is designated by the same reference number 40 as in FIGS. 1–3. Further, in FIGS. 5–7, the details of the ice pick are omitted for clarity.

Ice cleat 50 has a different buckle arrangement for the band. Band 52 is generally circular and terminates in ends that are secured to flanges 54, 55 that face one another. The ends of the band can be crimped, welded or riveted to flanges 54, 55 or otherwise secured in a conventional manner.

For tightening the band 52 around the outer frame member 12, a nut and screw arrangement is used that includes a hex head screw 56 and a square nut 57. Preferably, the square nut is received in a recess 58 in flange 55. Tightening of screw 56 is performed with the square nut 57 seated in recess 58. For removing the band, the screw is loosed until the square nut can be freed from recess 58 and the screw with the square nut still on passed through the open slotted end 59 of flange 55, shown in FIGS. 5 and 7.

Figure 6:
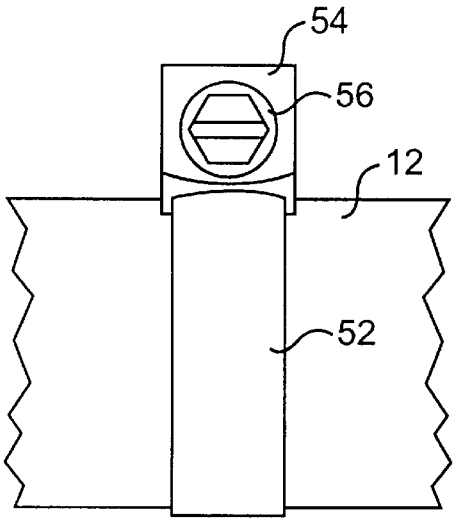
FIG. 6 is one side view of the clamp for the ice cleat shown in FIG. 5.
Figure 7:
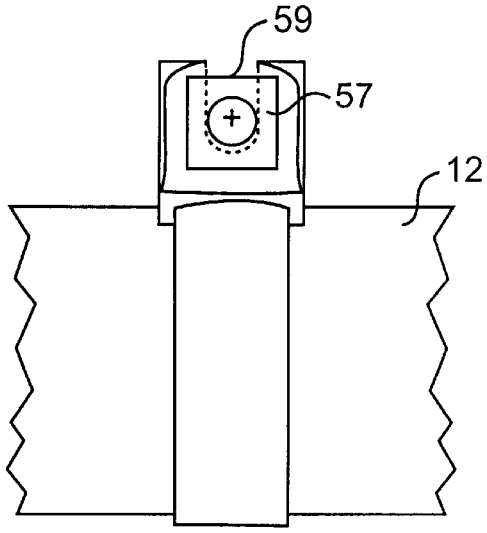
FIG. 7 is an opposite side view to that shown in FIG. 6 of the clamp for an ice cleat shown in FIG. 5.

FIG. 6 shows the opposite side view to FIG. 7 wherein the screw 56 passes through flange 54. Preferably, screw 54 is able to rotate with respect to flange 54, but is otherwise fixed to flange 54 to prevent it from being removed from flange 54, for convenience. That is, preferably the parts of the ice cleat are not separable when the band is loose upon removing it from the snowshoe. This aids in ensuring that the parts are not lost when removing/mounting the ice cleat in the field.

In both embodiments of the invention, the band can be loosened sufficiently to separate the ends of the band so that they may pass around outer frame member 12 when securing the band to the frame member or removing it therefrom. This ensures that the ice cleat can be mounted on the outer frame member(s) of various existing snowshoes without the need for modifying the snowshoe design.

I claim:

1. An ice cleat removably mounted on an outer frame member of a snowshoe, comprising:

a pick having opposite leg portions respectively having pointed ends and a mid portion between said leg portions;

a metal band for encircling an outer frame member of a snowshoe to secure said mid portion of said pick to an outer frame member of a snowshoe with said leg portions extending downwardly from said band; and a buckle for tightening said band, said band having opposite ends wherein one of said ends is fixed to said buckle and the other of said ends passes through said buckle to tighten said band, and further including a screw received in a threaded portion of said buckle wherein tightening said screw pushes an end of said screw against said band to tighten said band;

wherein said downwardly extending legs of said pick angle outwardly with respect to said band to prevent accumulation of material between said legs and wherein said ends of said legs of said pick are pointed to have a triangular shaped penetrating surface.

2. An ice pick according to claim 1, further including said buckle having facing first and second flanges and said band having opposite ends fixed respectively to said flanges and further including a nut and bolt for drawing said first and second flanges together for tightening said band.

3. An ice cleat according to claim 2, wherein one of said first and second flanges has a recess and wherein said nut is a square nut that fits within said recess to enable tightening of said buckle by turning said screw.

4. An ice cleat according to claim 3, further including said one flange having a slot for enabling said screw to pass through said slot when said nut has been loosened.

* * * * *